US006447065B1

(12) United States Patent
Ropp

(10) Patent No.: US 6,447,065 B1
(45) Date of Patent: Sep. 10, 2002

(54) ADJUSTABLE SWIVEL ASSEMBLY FOR SEAT SUSPENSIONS

(75) Inventor: Dale R. Ropp, Buda, IL (US)

(73) Assignee: Sears Manufacturing Company, Davenport, IA (US)

( * ) Notice: Subject to any disclaimer, the term of this patent is extended or adjusted under 35 U.S.C. 154(b) by 0 days.

(21) Appl. No.: 09/619,457

(22) Filed: Jul. 19, 2000

(51) Int. Cl.[7] ..... A47C 1/02; F16M 13/00

(52) U.S. Cl. ..... 297/344.21; 297/344.26; 248/349.1; 248/425

(58) Field of Search ..... 297/344.21, 344.22, 297/344.26; 248/425, 349.1

(56) References Cited

U.S. PATENT DOCUMENTS

| | | | | | |
|---|---|---|---|---|---|
| 3,834,660 | A | * | 9/1974 | Leffler | 248/425 X |
| 3,870,271 | A | * | 3/1975 | Bowman | |
| 4,401,287 | A | * | 8/1983 | Moeser | 248/425 |
| 4,705,256 | A | * | 11/1987 | Hofrichter | 248/349.1 X |
| 4,844,543 | A | * | 7/1989 | Ochiai | 248/425 X |
| 5,584,460 | A | * | 12/1996 | Ropp | 248/425 X |
| 5,599,065 | A | * | 2/1997 | Gryp et al. | 248/425 X |
| 5,720,462 | A | * | 2/1998 | Broderson | 248/344.21 X |
| 5,779,309 | A | * | 7/1998 | Lu | 297/344.26 |
| 5,810,441 | A | * | 9/1998 | Ezuka et al. | 297/344.26 |
| 6,021,989 | A | * | 2/2000 | Morita et al. | 248/349.1 |
| 6,161,806 | A | * | 12/2000 | Crosson | 248/349.1 X |

FOREIGN PATENT DOCUMENTS

| | | | |
|---|---|---|---|
| GB | 1 445 302 | * | 5/1974 |
| GB | 2 230 696 | * | 4/1990 |

OTHER PUBLICATIONS

Drawing of Sears Manufacturing Swivel Assembly.

* cited by examiner

*Primary Examiner*—Rodney B. White
(74) *Attorney, Agent, or Firm*—Niro, Scavone, Haller & Niro

(57) ABSTRACT

A swivel assembly for use in a seat suspension having a first swivel plate and an opposingly located second swivel plate with a plurality of ball bearings disposed between the swivel plates. The bearings permit the first swivel plate to rotate with respect to the second swivel plate. A lip is located inwardly from the bearings on the first swivel plate with the lip defining an aperture. An adjustment plate having an outer edge engages the lip. The adjustment plate also includes a plurality of sloped adjustment surfaces which increase in height and which have slots formed in the sloped adjustment surfaces. A plurality of fasteners extend through the slots into the second swivel plate and further engage the sloped adjustment surfaces. The adjustment plate and the sloped surfaces are rotatable about the fasteners to increase or decrease the pressure exerted on the bearings by urging the first plate towards or away from the second plate to adjust the rotational movement of the second swivel plate with respect to the first swivel plate.

16 Claims, 4 Drawing Sheets

FIG. 4
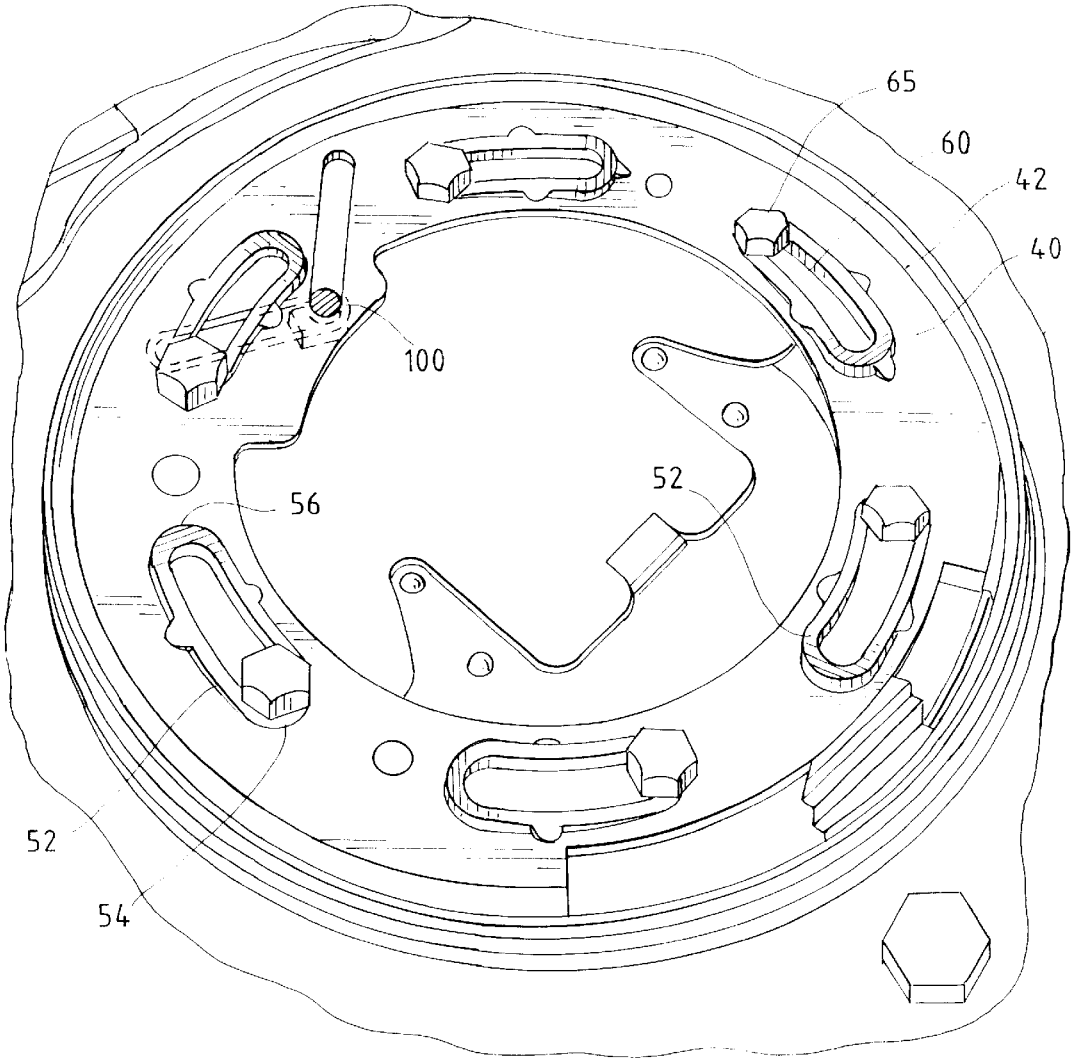
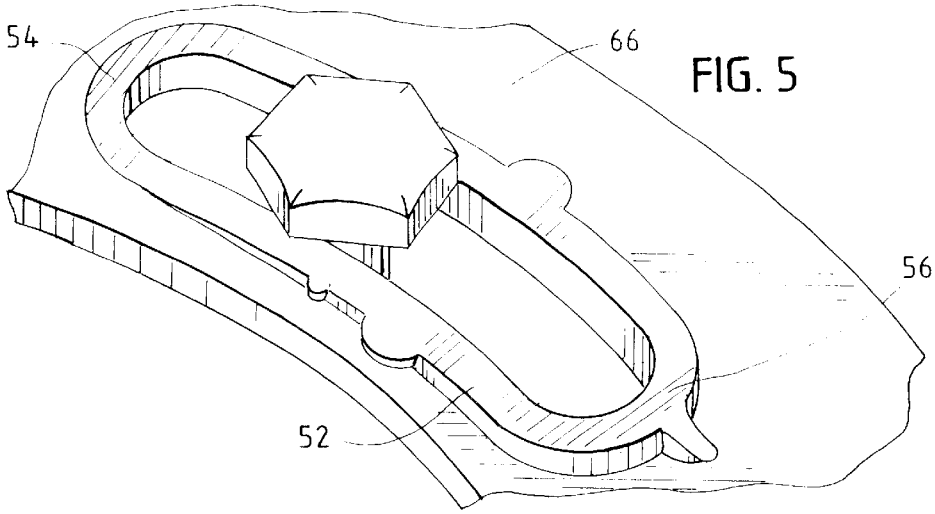
FIG. 5

ADJUSTABLE SWIVEL ASSEMBLY FOR SEAT SUSPENSIONS

BACKGROUND OF THE INVENTION

The invention relates to seat suspensions and swivel assemblies used therewith. More specifically, the present invention relates to a swivel assembly that includes an adjustment plate which controls the rotational movement of the seat by increasing or decreasing tension on a bearing assembly.

SUMMARY OF THE INVENTION

In many seat suspensions, a bearing assembly is often disposed between a first swivel plate and a second swivel plate which allows the first plate to rotate with respect to the second plate. To control the ease at which the seat swivels or the rotational movement, a biasing force is often used to urge the plates towards one another. The closer the plates are urged towards one another, the more pressure is exerted on the bearings, and as a result, a greater force is needed to rotate the seat. When the force is decreased, the seat swivels more freely.

However, controlling the biasing force often requires the user to control the distance between the plates and this is often difficult to accomplish because of the manufacturing processes used. It simply is not economically feasible to manufacture all of the parts involved in a swivel assembly within the manufacturing tolerances needed to maintain a set distance between the plates. To compensate for this, current practice is to use spacers, shims, and the like to control the distance between the plates, and consequently, the pressure on the bearings. The drawback in using this type of system is that the installation is labor intensive, precision is often difficult to achieve, and subsequent adjustments require new shims, spacers, and the like.

The present invention solves the above noted problems by using an adjustment plate that adjustably controls the pressure exerted on the bearings. The adjustment plate rests upon the first swivel plate and is connected to the second swivel plate by fasteners. A plurality of sloped surfaces having slots through which the fasteners pass permits the adjustment plate to rotate about the fasteners. As the plate is rotated in a direction which causes the fastener heads to engage the portion of the sloped surface which increases in height, the first swivel plate is urged towards the second swivel plate thereby increasing the pressure exerted on the bearing assembly which increases the resistance to rotational movement. Conversely, when the adjustment plate is rotated in the opposite direction towards the area of decreasing height, the resistance to rotational decreases since the distance between the plates increases.

DESCRIPTION OF THE DRAWINGS

These and other features, objects and advantages of the present invention will become apparent from the following description and drawings wherein like reference numerals represent like elements in several views, and in which:

FIG. 4 is a perspective view of an adjustment plate used with the present invention; and FIG. 5 an exploded view of a sloped adjustment surface.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
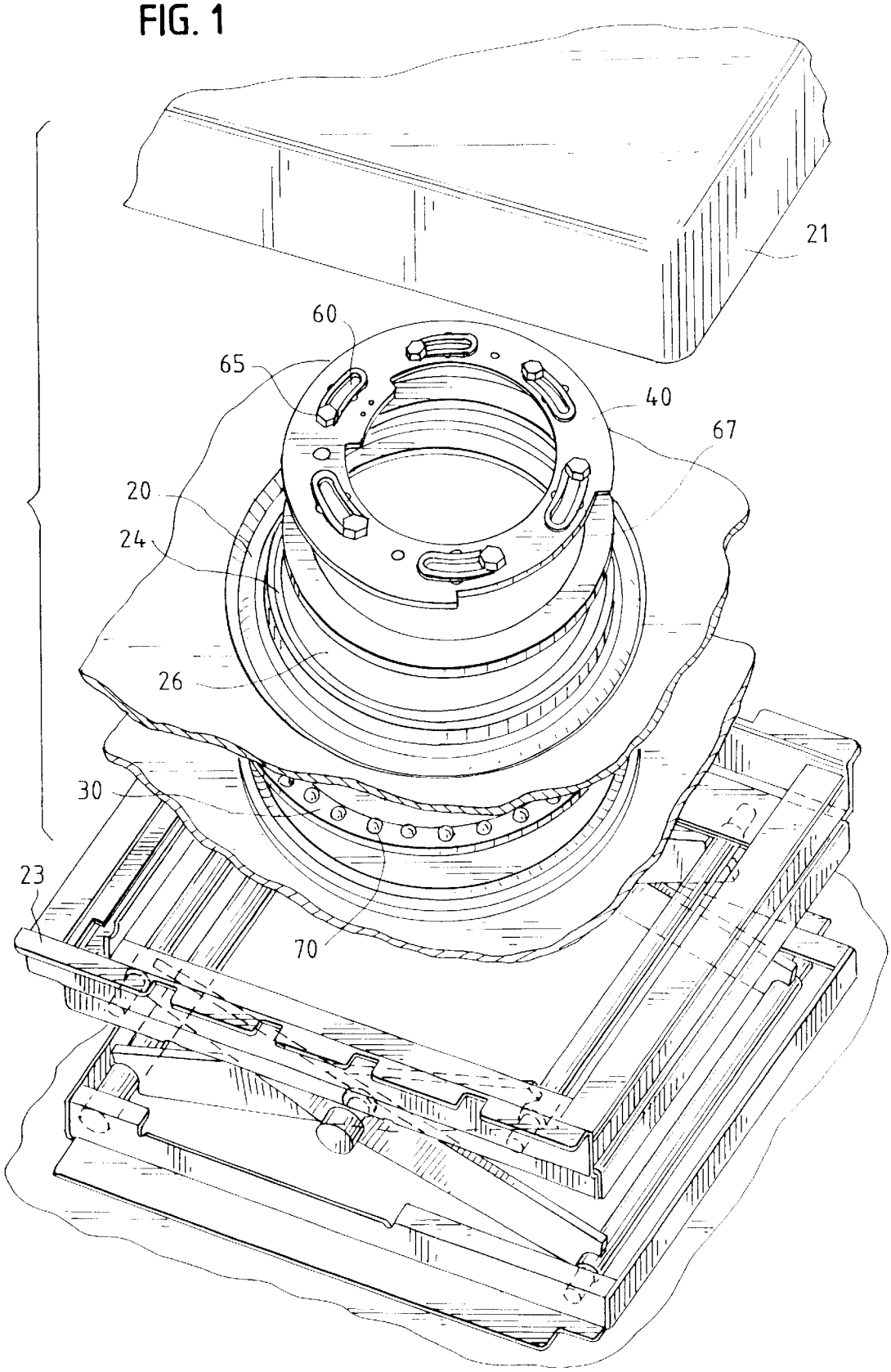
FIG. 1 is an exploded view of one embodiment of the present invention.
Figure 2:
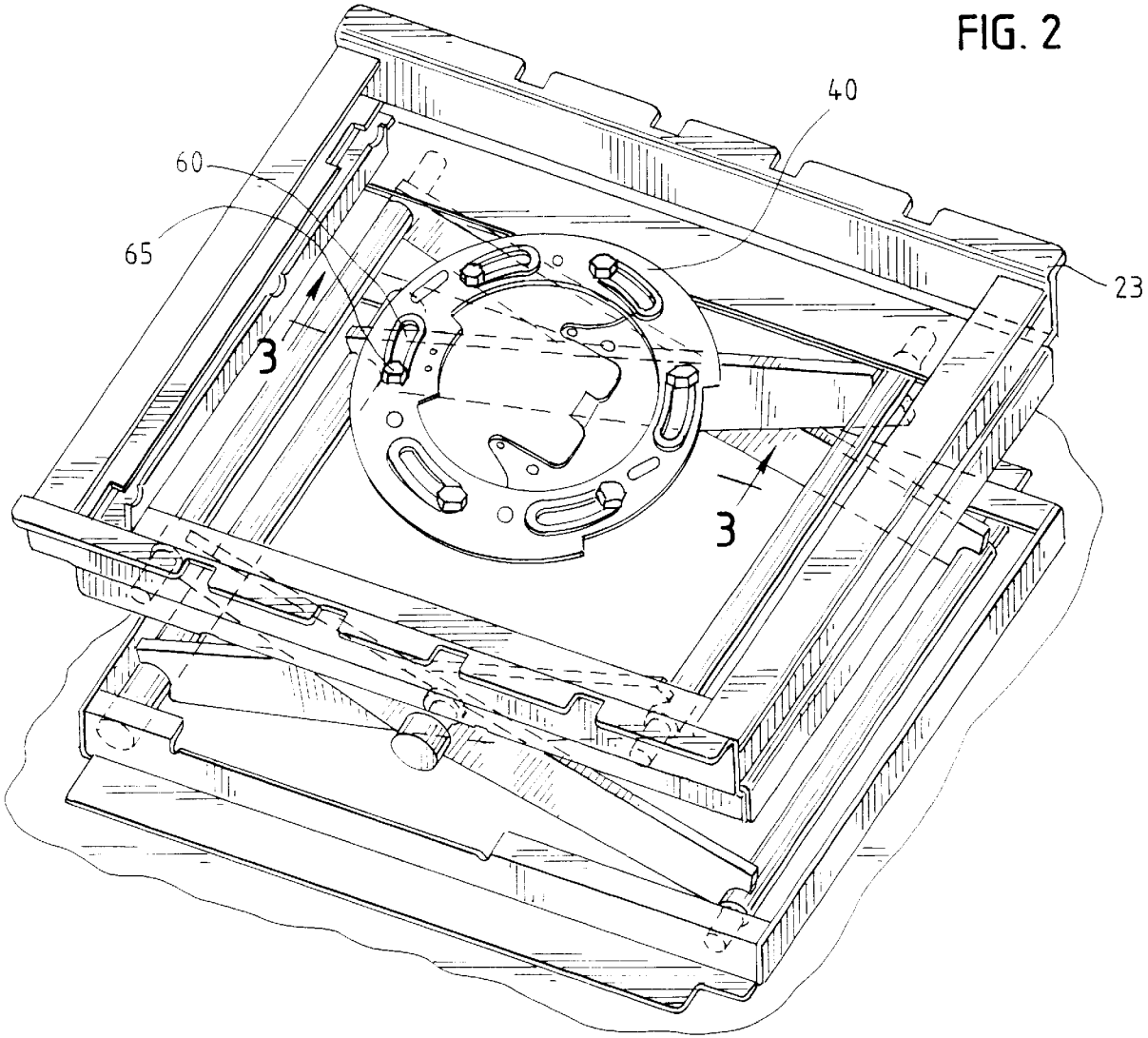
FIG. 2 is perspective view of one embodiment of the present invention with portions removed to reveal aspects of the invention.
Figure 3:
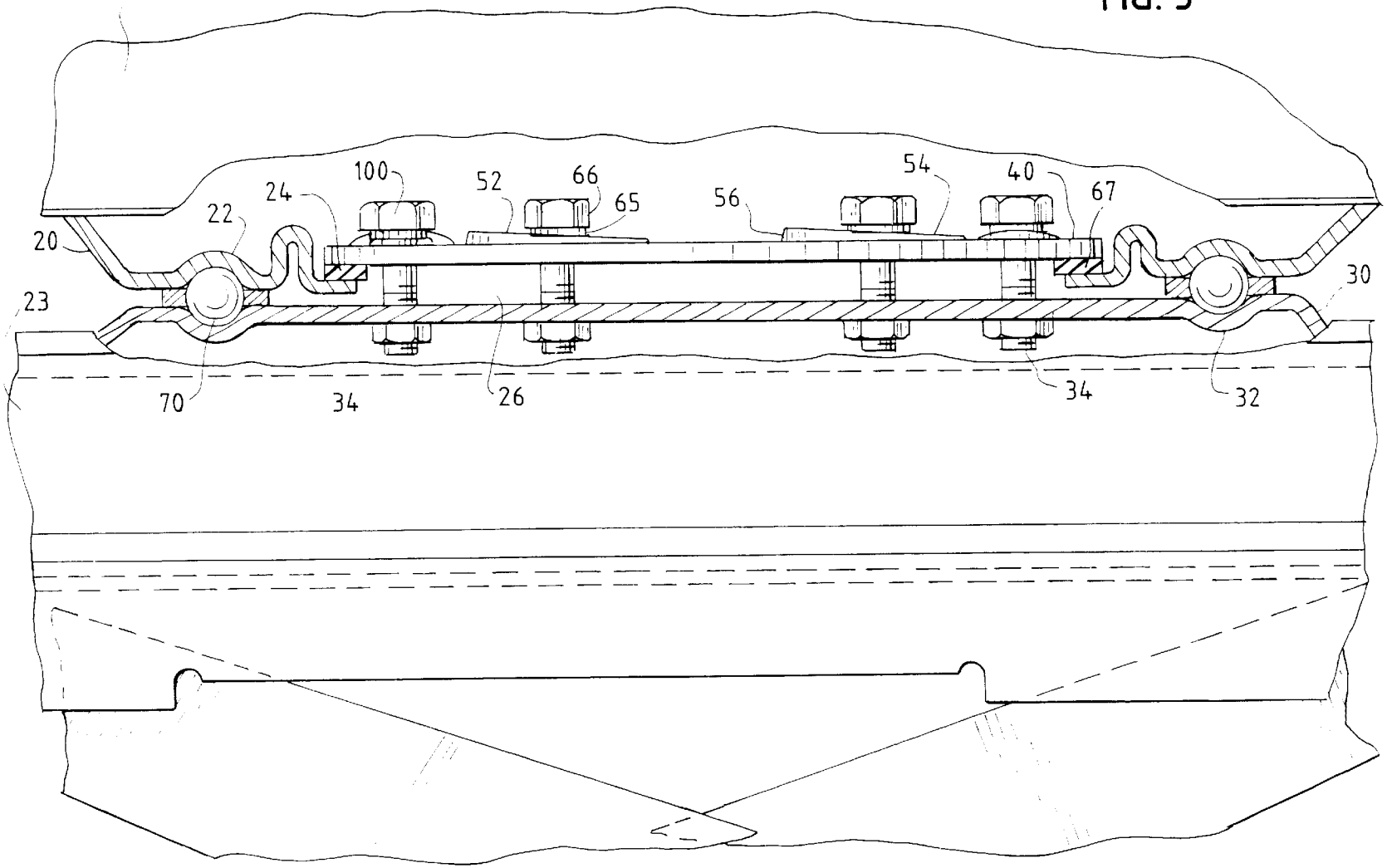
FIG. 3 is a cross sectional view of the embodiment shown in FIG. 2.

As shown in FIG. 1, one embodiment of the present invention includes a first swivel plate 20 which may be connected to a seat 21 which forms part of a seat suspension 23. As shown in FIG. 3, plate 20 includes a bearing track 22 and a lip 24 which defines an aperture 26. Opposingly located from plate 20 is second swivel plate 30 which may include a bearing track 32 and fasteners 34.

As shown in FIGS. 3–5, the present invention also includes an adjustment plate 40 which is adapted to engage first swivel plate 20. In one preferred embodiment of the invention, adjustment plate 40 has an outer edge 42 which is adapted to contact lip 24. Adjustment plate 40 also includes a plurality of sloped adjustment surfaces 52 which increase in height from end 54 to end 56. A plurality of slots 60 are circumscribed by sloped surfaces 52. Slots 60 are located inwardly toward the center of aperture 26 from lip 24 and edge 42 so as to allow fasteners 65 to extend through the slots and plate 40 into coacting fasteners 34 which are appropriately positioned on second swivel plate 30.

Bearings 70 are located in tracks 22 and 32. The bearings permit first swivel plate 20 to rotate with respect to second swivel plate 30. Alternately, a complete and separate bearing assembly may be disposed between plates 20 and 30 as well. This, of course, may eliminate the need for forming bearing tracks in the plates.

In use, bearings 70 are placed in track 32 of swivel plate 30 and then first swivel plate 20 is positioned to allow bearing tracks 22 to engage bearings 70 as well. Adjustment plate 40 is then placed into position by having outer edge 42 contact lip 24. Since lip 24 will rotate with respect to edge 42, to avoid metal to metal contact, a plastic bearing surface 67 of some other suitable material or device may be disposed between lip 24 and edge 42 to reduce friction.

To adjust the rotational movement of plate 20 with respect to plate 30, fasteners 65 are placed through slots 60 and into coacting engagement with fasteners 34. Typically, fasteners 65 are placed in the central portion of slots 60 and tightened as desired. Precision adjustments may then be made to the assembly by rotating adjustment plate 40 about fasteners 65. Rotating adjustment plate 40 in a direction which causes the fastener heads 66 to engage sloped surface 52 in a direction of increasing height towards end 56 results in first swivel plate 20 being urged or biased towards second swivel plate 30. This, in turn, increases the pressure exerted on bearings 70 by plates 20 and 30 which causes an increased resistance to rotation. Rotating adjustment plate 40 towards an area of decreasing height in a direction towards end 54 decreases the pressure on bearings 70 by plates 20 and 30. This, in turn, decreases the resistance to rotation.

Operating the device in this manner provides a simple and efficient method by which to adjust the rotational movement of the seat. Once the desired setting is obtained, the system may be locked in place by fastener or pin 100. Subsequent adjustment to the rotational movement may be made by simply unlocking the device and rotating plate 40 as desired.

While the invention has been described with reference to the preferred embodiments thereof, it will be appreciated that numerous variations, modifications, and alternate embodiments are possible, and accordingly, all such variations, modifications, and alternate embodiments are to be regarded as being within the spirit and scope of the invention.

What is claimed is:

1. A swivel assembly for use in a seat suspension comprising:

a first swivel plate having a bearing track;

a second swivel plate located opposite said first swivel plate, said second swivel plate having a bearing track;

a plurality of bearings disposed in said bearing tracks, said bearings permit said first swivel plate to rotate with respect to said second swivel plate;

an adjustment plate adapted to engage said first swivel plate and having a plurality of sloped adjustment surfaces which increase in height;

slots formed in said sloped adjustment surfaces and extending through said adjustment plate;

a plurality of fasteners extending through said slots and into said second swivel plate;

said fasteners engage said sloped adjustment surfaces; and said adjustment plate rotatable about said fasteners to either increase or decrease the pressure exerted on said bearings to adjust the rotational movement of said first swivel plate with respect to said second swivel plate by biasing said swivel plates towards one another or away from one another.

2. The device of claim 1 wherein said rotational movement of said adjustment plate in a direction of increasing height on said sloped surfaces biases said first swivel plate towards said second swivel plate to exert increased pressure on said bearings.

3. The device of claim 1 wherein said rotational movement of said adjustment plate in a direction of decreasing height on said sloped surfaces decreases the pressure exerted on said bearings.

4. The device of claim 1 further including a lip on said first swivel plate which defines an aperture and said adjustment plate has an outer edge which contacts said lip.

5. The device of claim 4 wherein said lip is located inwardly from said bearings.

6. The device of claim 4 wherein said fasteners extend through said slots and said aperture and into said second swivel plate.

7. The device of claim 4 further including a bearing surface disposed between said lip and said adjustment plate.

8. A swivel assembly for use in a seat suspension comprising:

a first swivel plate and a second swivel plate located opposite said first swivel plate;

at least one bearing disposed between said swivel plates, said at least one bearing permits said first swivel plate to rotate with respect to said second swivel plate;

an adjustment plate which engages said first swivel plate and having a plurality of sloped adjustment surfaces which increase in height;

slots formed in said sloped adjustment surfaces and extending through said adjustment plate;

a plurality of fasteners extending through said slots and into said second swivel plate;

said fasteners engage said sloped adjustment surfaces; and said adjustment plate and said sloped surfaces rotatable about said fasteners to either increase or decrease the pressure exerted on said at least one bearing to adjust the rotational movement of said first swivel plate with respect to said second swivel plate by biasing said swivel plates towards one another or away from one another.

9. The device of claim 8 wherein said rotational movement of said adjustment plate in a direction of increasing height on said sloped surfaces biases said first swivel plate towards said second swivel plate to exert increased pressure on said at least one bearing.

10. The device of claim 8 wherein said rotational movement of said adjustment plate in a direction of decreasing height on said sloped surface decreases the pressure exerted on said at least one bearing.

11. The device of claim 8 further including a lip on said first swivel plate which defines an aperture and said adjustment plate has an outer edge which contacts said lip.

12. The device of claim 11 wherein said lip is located inwardly from said bearing.

13. The device of claim 11 wherein said fasteners extend through said slots and aperture and into said second swivel plate.

14. The device of claim 11 further including a bearing surface disposed between said lip and said adjustment plate.

15. A swivel assembly for use in a seat suspension comprising:

a first swivel plate and a second swivel plate located opposite said first swivel plate;

at least one bearing disposed between said swivel plates, said bearing permits said first swivel plate to rotate with respect to said second swivel plate;

an adjustment plate which engages said first swivel plate and having a plurality of sloped adjustment surfaces which increase in height;

slots formed in said sloped adjustment surfaces and extending through said adjustment plate;

a plurality of fasteners extending through said slots and into said second swivel plate and in engagement with said sloped adjustment surfaces; and said adjustment plate rotatable about said fasteners in a direction of increasing height on said sloped surfaces to urge said first swivel plate towards said second swivel plate to create a biasing force which increases the pressure exerted on said bearing by said swivel plates and rotatable in a direction of decreasing height on said sloped surfaces to decrease the pressure exerted on said bearing by said swivel plates by biasing said swivel plates towards one another or away from one another.

16. A swivel assembly for use in a seat suspension comprising:

a first swivel plate and a second swivel plate located opposite said first swivel plate;

at least one bearing disposed between said swivel plates, said bearing permits said first swivel plate to rotate with respect to said second swivel plate;

a plurality of sloped adjustment surfaces adapted to coact with said swivel plates, said coaction in a direction of increasing height on said sloped surfaces urges said first swivel plate towards said second swivel plate to create a biasing force which increases the pressure exerted on said bearing by said swivel plates and coaction in a direction of decreasing height on said sloped surfaces decreases the pressure exerted on said bearing by said swivel plates by biasing said swivel plates towards one another or away from one another.

* * * * *